US007431082B2

(12) United States Patent
Holt et al.

(10) Patent No.: US 7,431,082 B2
(45) Date of Patent: Oct. 7, 2008

(54) RETAINING LINES IN BYPASS GROOVE ON DOWNHOLE EQUIPMENT

(75) Inventors: James H. Holt, Conroe, TX (US); Clark W. Beam, Madisonville, TX (US)

(73) Assignee: Baker Hughes Incorporated, Houston, TX (US)

( * ) Notice: Subject to any disclaimer, the term of this patent is extended or adjusted under 35 U.S.C. 154(b) by 195 days.

(21) Appl. No.: 11/208,204

(22) Filed: Aug. 19, 2005

(65) Prior Publication Data

US 2007/0039727 A1 Feb. 22, 2007

(51) Int. Cl.
*E21B 17/10* (2006.01)

(52) U.S. Cl. ..... 166/241.6; 166/242.2; 166/241.7; 166/65.1; 166/242.1

(58) Field of Classification Search ..... 166/65.1, 166/66, 206, 207, 242.1, 242.2, 385, 241.6, 166/241.7, 380, 241.1, 242.5; 174/136
See application file for complete search history.

(56) References Cited

U.S. PATENT DOCUMENTS 5,394,823 A * 3/1995 Lenze ..... 166/105
5,803,170 A 9/1998 Garcia-Soule et al.
5,892,860 A 4/1999 Maron et al.
6,554,064 B1 4/2003 Restarick et al.
6,681,854 B2 1/2004 Danos
6,805,202 B2 10/2004 Gillespie et al.
6,817,410 B2 11/2004 Wetzel et al.
6,877,553 B2 4/2005 Cameron
2002/0134549 A1 * 9/2002 Marangoni et al. ..... 166/242.1
2003/0000875 A1 1/2003 Echols et al.
2003/0168221 A1 * 9/2003 Zachman ..... 166/378
2004/0168794 A1 * 9/2004 Vold ..... 166/65.1
2004/0262013 A1 12/2004 Tilton et al.

FOREIGN PATENT DOCUMENTS

GB 2354782 A 4/2001
GB 2382831 11/2003

* cited by examiner

*Primary Examiner*—David J. Bagnell
*Assistant Examiner*—Sean D Andrish
(74) *Attorney, Agent, or Firm*—Steve Rosenblatt

(57) ABSTRACT

One or more control lines or other types of lines can be run past a downhole tool such as a side pocket mandrel, for example, in a longitudinal groove with a retaining feature for the control line where the assembly leaves little to stick out and get damaged on run in or on pulling out of the hole. In the preferred version, the groove is a dovetail and at least one retainer can be slipped into the dovetail. Lateral bores into the dovetail allow pins to be driven into a wedge shaped retainer to force it against the control line or lines such that the shape of the dovetail and the shape of the wedge retainer trap the control line within the dovetail. Upon assembly, nothing sticks out from the dovetail or the downhole tool.

15 Claims, 2 Drawing Sheets

RETAINING LINES IN BYPASS GROOVE ON DOWNHOLE EQUIPMENT

FIELD OF THE INVENTION

The field of this invention is downhole tools that have control lines or other types of lines that run past them and ways of retaining and protecting said line or lines as they pass the downhole tool.

BACKGROUND OF THE INVENTION

A frequent occurrence in downhole operations is the need to run control lines along a string and past downhole equipment to reach yet other equipment. The lines can conduct hydraulic fluid under pressure, or electric power, or electric signals in either direction. Frequently, a running string or production string is run through tight clearances and that causes a concern about damage to the control line or lines that are frequently run along side.

One solution that has been tried in the past is illustrated in FIGS. 1-5. FIG. 1 shows a side pocket mandrel 10, as an example. FIG. 2 is a section along lines 2-2 of FIG. 1 and shows the use of two parallel rods 12 and 14 that are shown in bigger scale in FIG. 3. In between rods 12 and 14 there is a valley 16 where a control line is disposed, although not shown in the FIGS. 1-5. FIG. 5 shows a hinge clamp 18 that has loops 20 and 22 that are sized to go over rods 12 and 14. FIG. 4 shows the clamp 18 slipped over the rods 12 and 14 and secured at each rod with a fastener 24. The clamp 18 was simply bolted at one loop such as 20 with a fastener 24 and then swiveled to align the loop 22 with the other rod so that another fastener 24 could be installed to retain the control line between rods 12 and 14 at either one of their ends. FIG. 1 shows the clamp 18 at both ends of the parallel rods 12 and 14. FIGS. 1 and 4 show deflection rods 26 having a tapered surface 28. These deflection rods 26 protected the ends of the rods 12 and 14 during running in or pulling out of the hole. The control line (not shown) would go through the deflection rod assembly 26 to give added protection to the lines as well as the parallel rods 12 and 14.

Those skilled in the art will appreciate that a big problem in this design was that it added to the diameter of the tool that was being run in. In some cases that would make it impossible to deliver the tool because the drift diameters downhole were simply not large enough. In other cases of close clearances the clamp 18 would get hung up and get sheared off and the control line or lines would come out from between rods 12 and 14 and would get damaged.

Another proposal to improve the previously described attempt was to take away some on the wall thickness such as at the thick portion of a side pocket mandrel and simply guide the control line through the longitudinal groove. While this idea did not add to the outer dimension of the assembly, it had another shortcoming. There were no provisions for retaining the control line in the groove except external bands that simply defeated the purpose of the recessed groove by adding back bulk that would either prevent advancement of the assembly altogether or it would present components sticking out that could get snagged and stick the tool or get sheared off.

What is needed and provided by the present invention is a way of retaining the control line or lines in a recess without components that stick out by allowing the placement of retainers at desired locations. These and other advantages of the present invention will be more readily apparent to those skilled in the art from a review of the description of the preferred embodiment and the claims that appear below.

SUMMARY OF THE INVENTION

One or more control lines or other types of lines can be run past a downhole tool such as a side pocket mandrel, for example, in a longitudinal groove with a retaining feature for the control line where the assembly leaves little to stick out and get damaged on run in or on pulling out of the hole. In the preferred version, the groove is a dovetail and at least one retainer can be slipped into the dovetail. Lateral bores into the dovetail allow pins to be driven into a wedge shaped retainer to force it against the control line or lines such that the shape of the dovetail and the shape of the wedge retainer trap the control line within the dovetail. Upon assembly, nothing sticks out from the dovetail or the downhole tool.

DETAILED DESCRIPTION OF THE DRAWINGS

DETAILED DESCRIPTION OF THE PREFERRED EMBODIMENT

Figure 1:
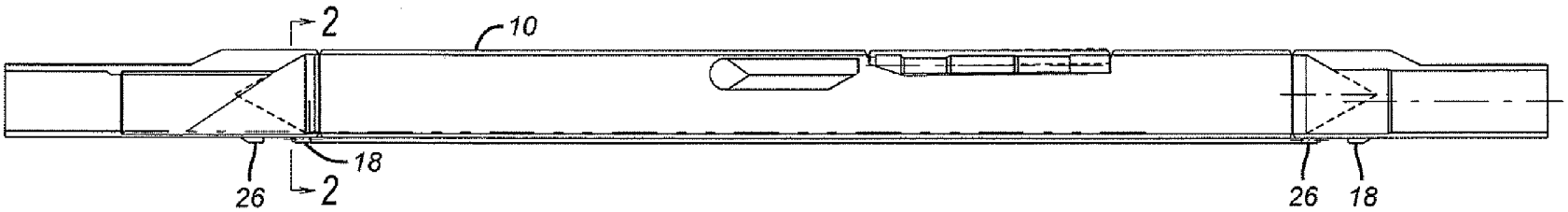
(PRIOR ART) FIG. 1
FIG. 1 is an elevation view of a prior design using parallel rods and a clamp at opposed ends.
Figure 6:
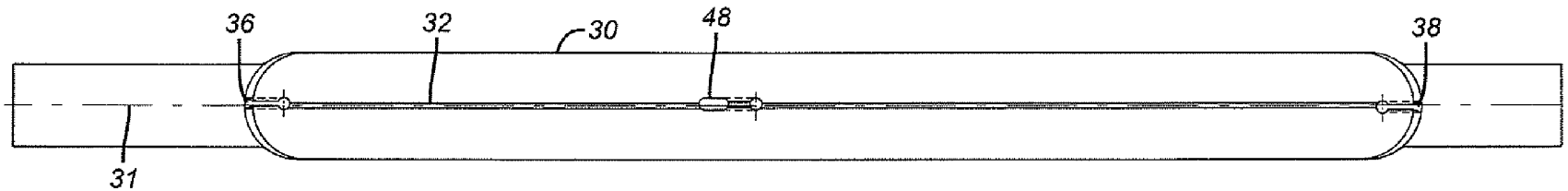
FIG. 6 is an elevation view of the present invention shown in the context of a side pocket mandrel.
Figure 3:
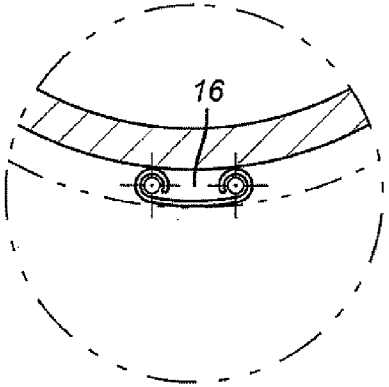
(PRIOR ART) FIG. 3
FIG. 3 is a larger scale view of FIG. 2.
Figure 2:
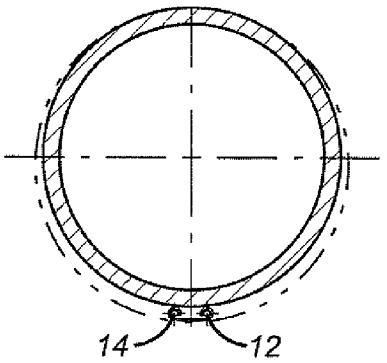
(PRIOR ART) FIG. 2
FIG. 2 is a section view along lines 2-2 of FIG. 1.
Figure 5:
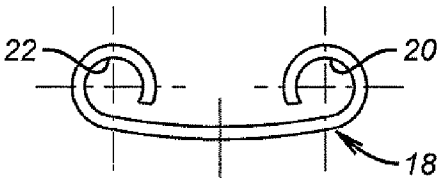
(PRIOR ART) FIG. 5
FIG. 5 is a detailed view of the clamp at the rod ends shown in FIG. 4.
Figure 7:
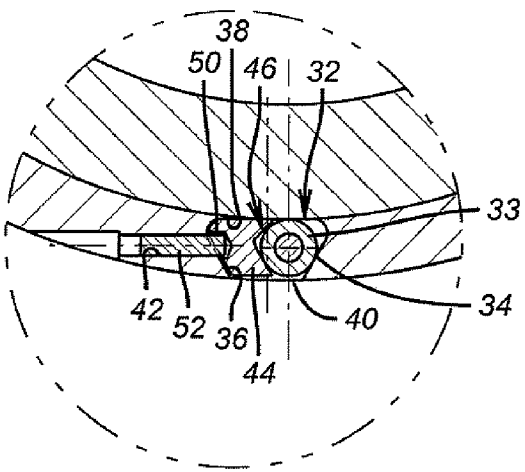
FIG. 7 is a section through the dovetail groove showing a control line held in place by a wedge.
Figure 4:
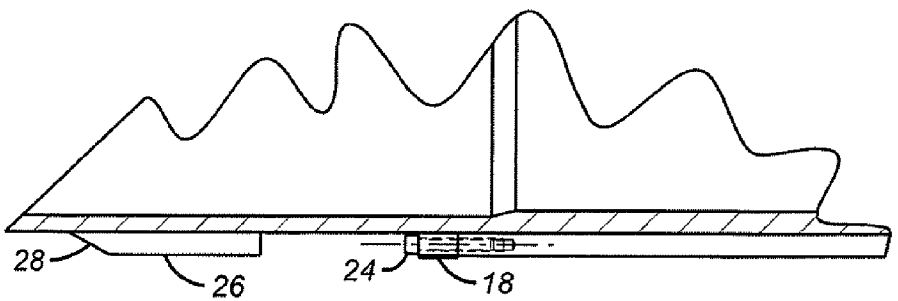
(PRIOR ART) FIG. 4
FIG. 4 is a detailed view at the ends of the rods shown in FIG. 1.

FIG. 6 shows a downhole tool such as a side pocket mandrel 30. Preferably it has a longitudinal slot 32 aligned with its central axis 31. Preferably, slot 32 is open on opposed ends 36 and 38. In selected sections, as shown in FIG. 7, slot 32 has opposing reverse sloped walls 34 and 36 and an inside wall 38. In other portions the slot 32 can have a u-shape or another cross-section. It can be dovetailed as shown in FIG. 7 for its entire length, as another option. A "control line" 33 specially defined herein to mean any type of an extending member used downhole to convey flow, pressure, power, signals or for any other downhole purpose, is inserted through the opening 40 and moved to a corner formed by inside wall 38 and one of the adjacent sloped walls, in this case 34 since bore 42 comes through wall 36. A wedge 44 has a leading bevel surface 46 to engage control line 33 to push it into the corner defined by surfaces 34 and 38. Except at ends 36 and 38 where the wedge 44 can simply be slid into the groove 32 in other portions of the groove 32 a wide spot 48 can be machined to allow for initial insertion of the wedge 44 into the groove 32 at that location. The wedge is then slid in the groove 32 until it enters the dovetail cross-section, as shown in FIG. 7 and the shallow bore 50 is aligned with bore 42. At that point a pin 52 is driven into bore 42 and eventually drives the wedge 44 through the shallow bore 50 into the control line 33. Preferably the pin 52 has an interference fit in bore 42 to keep it from falling out once driven home. Other techniques can be used to retain the pin 52 such as threads, without departing from the invention. More than one control line can be secured in the manner shown.

Wedge points can occur at desired locations along the groove 32. The wedge 44 can take a variety of forms within the scope of the invention. The groove shape can be varied as can the shape of the wedge 44, which can conform or not to the shape of the control line 33. The cross-sectional shape of the groove 32 can vary or be constant. Consistently, despite variations in the details, the control line 33 should be secured within groove 32 without exposing the control line 33 so that it could be damaged and without retaining devices that keep the control line 33 in place from extending beyond the groove 32 in a manner that could get such devices snagged going into or out of the wellbore or in a way that limits the ability of the downhole tool to pass a predetermined drift diameter. While one wedge is shown, opposing wedges can be used to hold the control line anywhere in the groove 32. The wedges can be mirror images or they can be different. Walls 34 and 36 can be flat or curved or sloping toward each other, or parallel or sloping away from each other.

The above description is illustrative of the preferred embodiment and many modifications may be made by those skilled in the art without departing from the invention whose scope is to be determined from the literal and equivalent scope of the claims below.

We claim:

1. An assembly for extending at least one control line past a downhole tool having an elongated body defining an outermost dimension, comprising:

at least one groove having a longitudinal opening in the body to accommodate insertion of at least one control line, said longitudinal groove comprising a longitudinal axis; and at least one retainer movable in said groove and acting within said outermost dimension to selectively secure the control line within said groove, said retainer being actuated by a member movably mounted to said body and extending through a passage other than said opening in the body that intersects said groove.

2. The assembly of claim 1, wherein:

said retainer acts within said groove.

3. The assembly of claim 2, wherein:

said retainer comprises a wedge.

4. The assembly of claim 3, wherein:

said wedge is movable in said groove transversely to abut said control line.

5. The assembly of claim 4, wherein:

said wedge has a leading end that conforms to the shape of said control line.

6. The assembly of claim 5, wherein:

said leading end is contoured to the shape of the control line.

7. The assembly of claim 5, wherein:

said groove cross-section taken transversely to said longitudinal plane at the elevation of said wedge is formed to retain the control line to said groove.

8. The assembly of claim 7, wherein:

said groove comprises a pair of opposed walls that slope toward each other.

9. The assembly of claim 8, wherein:

said walls are flat.

10. An assembly for extending at least one control line past a downhole tool having an elongated body defining an outermost dimension, comprising:

at least one longitudinal groove in the body to accommodate at least one control line, said longitudinal groove comprising a longitudinal axis through which extends a longitudinal plane; and at least one retainer movable in said groove transversely to said longitudinal plane and acting within said outermost dimension to selectively secure the control line within said groove;

said retainer acts within said groove;

said retainer comprises a wedge;

said wedge is movable in said groove transversely to abut said control line;

said wedge has a leading end that conforms to the shape of said control line;

said groove cross-section taken transversely to said longitudinal plane at the elevation of said wedge is formed to retain the control line to said groove;

said groove comprises a pair of opposed walls that slope toward each other;

said groove further comprises a bore through the elongated body extending through at least one of said walls.

11. The assembly of claim 10, wherein:

said bore comprises a pin insertable therethrough into contact with said wedge.

12. The assembly of claim 11, wherein:

said pin retained in said bore by an interference fit.

13. The assembly of claim 11, wherein:

said pin removably mounted to said bore.

14. The assembly of claim 5, wherein:

said wedge comprises a plurality of wedges driven in opposed directions toward each other from opposing sides of said groove.

15. The assembly of claim 1, wherein:

said groove comprises converging walls to trap the control line when pushed against them.

* * * * *